US006955003B1

(12) United States Patent
Lew et al.

(10) Patent No.: US 6,955,003 B1
(45) Date of Patent: Oct. 18, 2005

(54) ARTICLE AND METHOD FOR ENABLING THE FORMING OF A THEME REPRESENTATION TEMPLATE COLLAGE

(75) Inventors: Jeffrey S. Lew, Santa Monica, CA (US); Paul M. Mann, Redondo Beach, CA (US)

(73) Assignee: Framing Success, Inc., Virginia Beach, VA (US)

( * ) Notice: Subject to any disclaimer, the term of this patent is extended or adjusted under 35 U.S.C. 154(b) by 0 days.

(21) Appl. No.: 10/742,134

(22) Filed: Dec. 19, 2003

(51) Int. Cl.[7] ..... A47G 1/06
(52) U.S. Cl. ..... 40/768; 40/735
(58) Field of Search ..... 40/768, 124.11, 40/615, 735, 580; D6/302, 301

(56) References Cited

U.S. PATENT DOCUMENTS 2,259,272 A * 10/1941 Sholkin et al. ..... 40/611.05
2,547,359 A * 4/1951 Bacharach ..... 446/147
3,024,553 A 3/1962 Rowley
4,200,222 A * 4/1980 Feuer ..... 229/92.8
D276,055 S * 10/1984 Guertin ..... D21/337
4,662,093 A 5/1987 Suttles
4,794,716 A * 1/1989 George et al. ..... 40/735
5,096,752 A * 3/1992 Wagner ..... 428/13
D357,588 S * 4/1995 Fachinger ..... D6/304
D373,027 S * 8/1996 Hulback et al. ..... D6/303
D421,186 S 2/2000 Fairweather
6,358,341 B1 * 3/2002 Bergquist ..... 156/63
6,796,066 B2 * 9/2004 Champnella, II ..... 40/735

* cited by examiner

*Primary Examiner*—Gary C. Hoge
(74) *Attorney, Agent, or Firm*—Kimberly A. Chasteen

(57) ABSTRACT

An article and method for providing a theme representation template for a collage display. The article, in an embodiment thereof, enables a template in the form of a representation of a theme to be overlaid on a collage of materials assembled so as to be visible through cutout portions of the theme representation template. It also enables enhanced formatting of collage materials for theme viewing and displaying thereof.

9 Claims, 2 Drawing Sheets

ARTICLE AND METHOD FOR ENABLING THE FORMING OF A THEME REPRESENTATION TEMPLATE COLLAGE

BACKGROUND OF THE INVENTION

1. Field of the Invention

The present invention relates generally to improvements in displays of collage materials. In particular, it relates to an improved article and method for enabling a theme representation template collage to be formed.

2. Description of the Related Art

The article and method of the present invention are particularly useful in enabling a collage of materials to be applied to a support surface, and to be visible in a theme representation format through an overlaid theme representation template.

A variety of articles and methods have been developed over the years for forming a collage by securing various materials to a support surface in a desired arrangement thereof. The materials utilized in forming such a collage may include photographs, pictures, newspaper articles, portions thereof or the like, assembled so as to cover a support surface in the desired manner.

It would be desirable to provide a collage which could be displayed in the form of a representation of a theme which may have particular significance to the person creating the collage.

Therefore, the present invention provides improved articles and methods for providing a theme representation template for enabling a collage of materials to be displayed in the form of the representation of the theme.

SUMMARY OF THE INVENTION

The present invention, in general, provides a new and improved article and method for providing a template in the form of a representation of a theme for enabling the creation of a theme representation template collage as desired for viewing and display thereof.

More particularly, for example, in an embodiment of the present invention, an article is provided for enabling the forming of a theme representation template collage. The article includes a support surface for enabling materials to be arranged thereon and applied thereto, and a template configured as a representation of a theme and able to be overlaid on the support surface, including cutout portions. The materials are arranged on and applied to the support surface in the form of a collage, and the template is overlaid thereover such that the collage materials are visible through the cutout portions of the theme representation template.

The above objects and advantages of the present invention, as well as others, are described in greater detail in the following description, when taken in conjunction with the accompanying drawings of illustrative embodiments.

DETAILED DESCRIPTION OF THE PREFERRED EMBODIMENTS

The present invention is directed to an improved article and method for enabling the forming of a theme representation template collage so as to enable a collage of materials applied to a support surface to be visible in a theme representation format through a theme representation template overlaid thereon. The invention enables the creation of a display of a collage with a theme representation template which may be of significance to the person creating it as a memento or keepsake. The preferred embodiments of the improved article are illustrated and described herein by way of example only and not by way of limitation.

Figure 1:
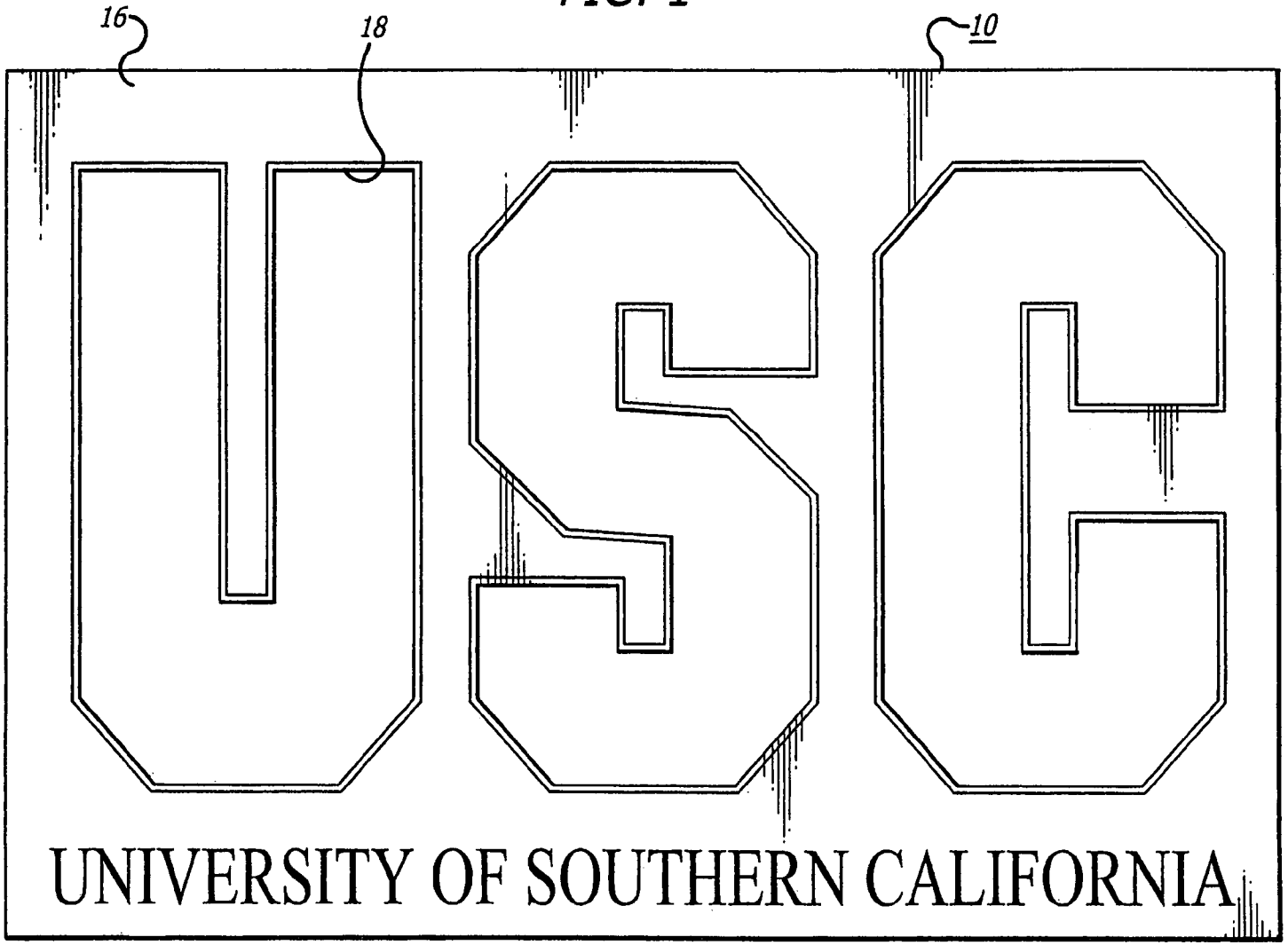
FIG. 1 is an elevational view of a theme representation template in accordance with an embodiment of the present invention.
Figure 2:
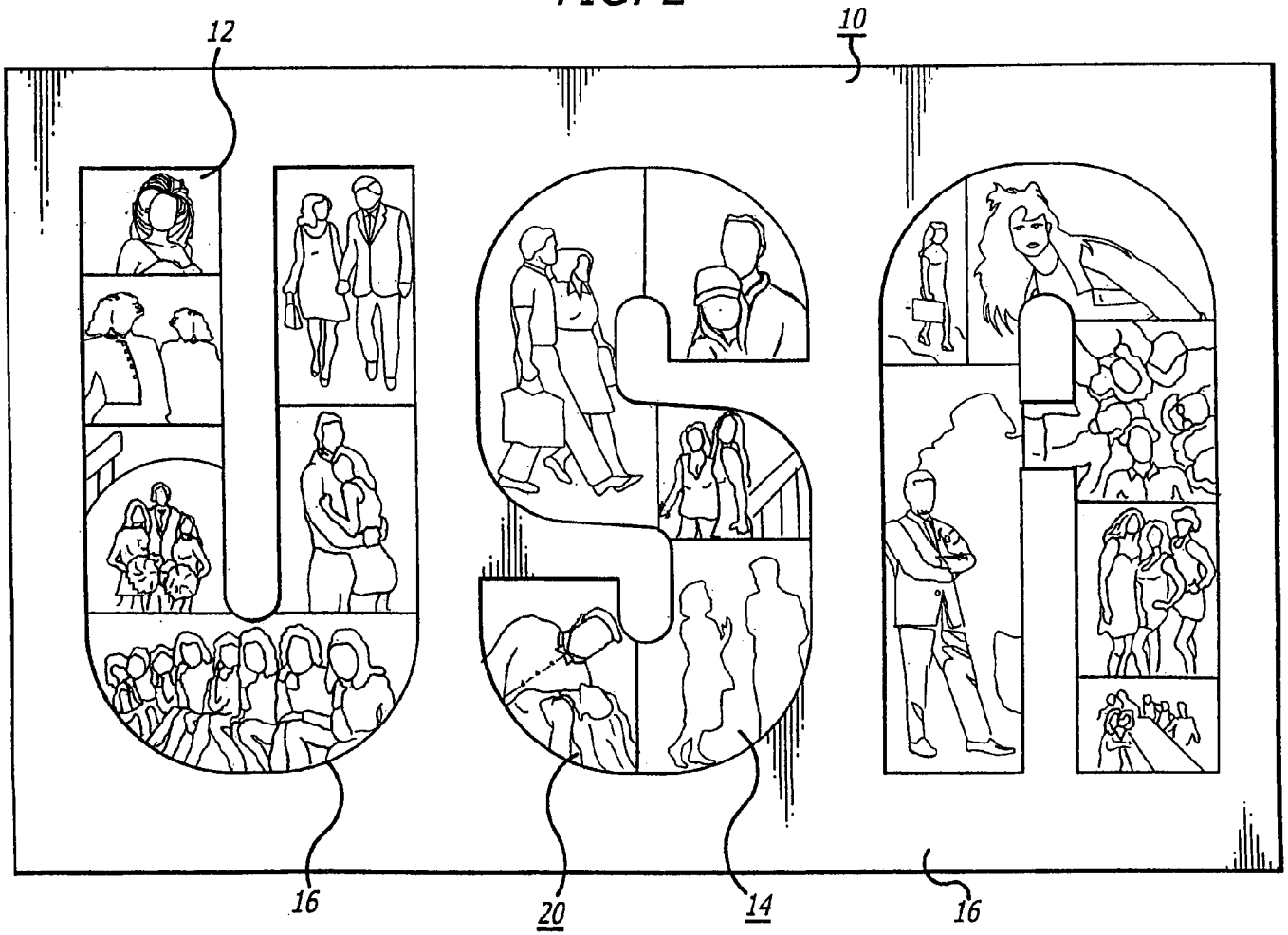
FIG. 2 is an elevational view of a theme representation template overlaid on a collage pursuant to an embodiment of the invention.

In the drawings, wherein like reference numerals denote like or corresponding parts throughout the drawing figures, and particularly in the preferred embodiments in accordance with the invention, as shown in FIGS. 1–2, for example, an article 10 is provided for enabling the forming of a theme representation template collage.

Referring to FIGS. 1–2, in a preferred embodiment pursuant to the present invention, for example, the article 10 comprises a support surface 12, which enables materials 14 to be arranged therein and applied thereto. The article 10 further includes a template 16 which is configured as a representation of a theme, which is able to be overlaid on the support surface 12 and which includes cutout portions 18. The materials 14 are able to be arranged on and applied to the support surface 12 in the form of a collage 20. The template 16 is able to be overlaid over the collage 20 so as to enable the materials 14 of the collage 20 to be visible through the cutout portions 18 of the template 16.

The support surface 12, for example, may include, but is not limited to, a cardboard backing or the like. The materials 14 may include, for example, but not be limited to, mementos or items of interest such as photographs, pictures, newspaper articles or the like. The template 16 may be prefabricated and may be a generally thin sheet of material in the form of a matte or the like. The theme representation template 16 may comprise, for example, but not be limited to, a proprietary, licensed or public domain theme representation such as, for example, a name, nickname, initials, logo, mascot, slogan, likeness or the like, of a high school, college or other educational institution, fraternity or sorority, professional or amateur athletic team, the military, a city, state or country, a person or a pet, an entertainment-related persona or image, or the like. The theme representation template 16 may further comprise, alternatively or additionally, for example, but not be limited to, trading cards, weddings, birthdays, holidays, special occasions, sports, music, movies, dates, days, months, years, travel destinations, theme parks, astrological signs, events, associations, clubs, groups, organizations, animals, insignias, trademarks, automobiles, planes or the like. The collage 20 may be formed by applying the materials 14 to the support surface 12 as by pasting or gluing the materials 14 thereon. The materials 14 may be arranged so as to be visible entirely or as portions thereof through the cutout portions 18 of the template 16 overlaid thereon.

As illustrated in FIGS. 1–2, in a method for the use of the preferred embodiment in accordance with the present invention, for example, the theme representation template 16 is placed over the support surface 12 to which the collage 20 is to be applied, and the cutout portions 18 of the template 16 are traced onto the support surface 12. The materials 14 for the collage 20 are then arranged on the support surface 12 such that the portions thereof which are to be visible are within the tracing on the support surface 12. The arranging of the materials 14 may comprise arranging the materials 14 so as to be entirely visible or partially visible through the template 16. It may comprise arranging the materials 14 on a cardboard backing support surface 12. The template 16 is then overlaid on the support surface 12 such that the collage materials 14 are visible through the theme representation template cutout portions 18. The overlaying may comprise overlaying the generally thin sheet template 16 such as, for example, a matte. It also comprises overlaying the template 16 which may comprise the proprietary template, the licensed template or the public domain template. The theme representation template collage article 10 may then be displayed as is, inserted into a frame or otherwise prepared for display thereof.

In accordance with the present invention, the particular embodiments set forth above for the article 10 are capable of providing a theme representation template collage for display and viewing thereof. However, other forms of the article 10 may be utilized with the present invention without departing from the spirit and scope of the invention. For example, the article 10 may be implemented with other types of theme representation template formats. Additionally, while the article 10 is shown and described in reference to particular materials for the theme representation template and the collage in the embodiment herein, it can include other types of materials depending upon the nature thereof as desired. Based on the present disclosure, other constructions and applications are known to one skilled in the art.

In view of the above, it is apparent that the article and method of the preferred embodiments of the present invention enhance substantially the formatting of displays of collage materials to enable the creation of theme representation template collage display thereof.

While the present invention has been described in connection with the specific embodiments identified herein, it will be apparent to those skilled in the art that many alternatives, modifications and variations are possible in light of the above description. Accordingly, the invention is intended to embrace all such alternatives, modifications and variations as may fall within the spirit and scope of the invention disclosed herein.

What is claimed is:

1. A method of enabling the forming of a theme representation template collage in an article which comprises a support surface adapted to enable materials to be arranged thereon and applied thereto, and a template adapted to be configured as a representation of a theme and to be overlaid on the support surface, including cutout portions, wherein the materials are adapted to be arranged on and applied to the support surface in the form of a collage, and the template is adapted to be overlaid thereover such that the collage materials are visible through the cutout portions of the theme representation template, wherein the method comprises:

placing the theme representation template over the support surface and tracing the cutout portions of the theme representation template onto the support surface;

arranging the materials on the support surface such that the portions of the materials which are to be visible are within the tracing on the support surface and applying the materials to the support surface in the form of the collage; and overlaying the theme representation template on the support surface such that the collage materials are visible through the theme representation template cutout portions.

2. The method of claim 1, wherein the template comprises a generally thin sheet and wherein overlaying the theme representation template comprises overlaying the generally thin sheet theme representation template.

3. The method of claim 1, wherein the theme representation template comprises a proprietary theme representation template and wherein overlaying the theme representation template comprises overlaying the proprietary theme representation template.

4. The method of claim 1, wherein the theme representation template comprises a licensed theme representation template and wherein overlaying the theme representation template comprises overlaying the licensed theme representation template.

5. The method of claim 1, wherein the theme representation template comprises a public domain theme representation template and wherein overlaying the theme representation template comprises overlaying the public domain theme representation template.

6. The method of claim 1, wherein the collage materials are adapted to be arranged so as to be entirely visible through the theme representation template cutout portions and wherein arranging the materials comprises arranging the materials so as to be entirely visible through the theme representation template cutout portions.

7. The method of claim 1, wherein the collage materials are adapted to be arranged so as to be partially visible through the theme representation template cutout portions and wherein arranging the materials comprises arranging the materials so as to be partially visible through the theme representation template cutout portions.

8. The method of claim 1, wherein the support surface comprises a cardboard backing and wherein arranging the materials comprises arranging the materials on the cardboard backing support surface.

9. The article of claim 2, wherein the generally thin template sheet comprises a matte and wherein overlying the theme representation template comprises overlaying the matte theme representation template.

* * * * *